US012433325B2

(12) United States Patent
Fuhrmann et al.

(10) Patent No.: US 12,433,325 B2
(45) Date of Patent: Oct. 7, 2025

(54) ELONGATED SMOKING ARTICLE

(71) Applicant: REEMTSMA CIGARETTENFABRIKEN GMBH, Hamburg (DE)

(72) Inventors: Jan Fuhrmann, Hamburg (DE); Edward Cooper, Hamburg (DE)

(73) Assignee: REEMTSMA CIGARETTENFABRIKEN GMBH, Hamburg (DE)

( * ) Notice: Subject to any disclaimer, the term of this patent is extended or adjusted under 35 U.S.C. 154(b) by 795 days.

(21) Appl. No.: 17/297,401

(22) PCT Filed: Dec. 12, 2019

(86) PCT No.: PCT/EP2019/084796
§ 371 (c)(1),
(2) Date: May 26, 2021

(87) PCT Pub. No.: WO2020/126782
PCT Pub. Date: Jun. 25, 2020

(65) Prior Publication Data

US 2022/0030933 A1 Feb. 3, 2022

(30) Foreign Application Priority Data

Dec. 17, 2018 (EP) ..... 18212908

(51) Int. Cl.
*A24D 1/02* (2006.01)
*A24D 1/00* (2020.01)
*A24D 1/04* (2006.01)

(52) U.S. Cl.
CPC ..... *A24D 1/025* (2013.01); *A24D 1/002* (2013.01); *A24D 1/045* (2013.01)

(58) Field of Classification Search
None
See application file for complete search history.

(56) References Cited

U.S. PATENT DOCUMENTS 6,976,493 B2 * 12/2005 Chapman ..... A24D 1/025 131/365
2004/0134631 A1 * 7/2004 Crooks ..... A24D 1/025 131/365

(Continued)

FOREIGN PATENT DOCUMENTS

| | | | |
|---|---|---|---|
| CA | 2438908 | A | 9/2002 |
| CN | 108477672 | A | 9/2018 |
| EP | 2 219 481 | B1 | 9/2012 |
| RU | 2555651 | C2 | 7/2015 |
| RU | 2672304 | C1 | 11/2018 |
| WO | WO 2009/080604 | A1 | 7/2009 |

(Continued)

OTHER PUBLICATIONS

Extended European Search Report for corresponding Application No. 18212908.0, dated Jul. 10, 2019, 7pp.

(Continued)

*Primary Examiner* — Philip Y Louie
*Assistant Examiner* — Jeffrey A. Buckman
(74) *Attorney, Agent, or Firm* — Fox Rothschild LLP

(57) ABSTRACT

The present invention relates to an elongated smoking article that extends in a longitudinal direction and comprises a cylindrical smoking body with a combustible material that is surrounded by a wrapping paper. The smoking article further comprises a filter element that is configured to reduce substances from combustion gases drawn through the filter element from the burning smoking body. A first base area of the filter element faces a base area of the smoking body and a second base area is an open base area. A tipping paper is circumscribing the smoking body and the filter element and is attached to external surfaces of the smoking body and the filter element. A flavoring is disposed in or on the tipping paper spaced apart from the second base area in the longitudinal direction and with a distribution that varies in a longitudinal direction of the tipping paper.

19 Claims, 4 Drawing Sheets

(56) References Cited

U.S. PATENT DOCUMENTS

| | | | | |
|---|---|---|---|---|
| 2010/0108081 | A1* | 5/2010 | Blevins Joyce | A24D 1/025 131/274 |
| 2017/0360086 | A1 | 12/2017 | Kaljura et al. | |

FOREIGN PATENT DOCUMENTS

| | | | |
|---|---|---|---|
| WO | WO 2014/012841 | A2 | 1/2014 |
| WO | WO 2014/012841 | A3 | 1/2014 |
| WO | WO 2018/007626 | A1 | 1/2018 |
| WO | WO 2018/078316 | A1 | 5/2018 |

OTHER PUBLICATIONS

International Search Report and Written Opinion for corresponding International Application No. PCT/EP2019/084796, dated Apr. 3, 2020, 20pp.

European Office Action for EP Application No. 18212908.0 dated May 10, 2023, 4 pages.

Russian Office Action for RU Application No. 2021111777/03(025199) dated Dec. 23, 2022, 7 pages.

Extended European Search Report for corresponding Application No. 18212906.4, dated Jul. 10, 2019, 7pp.

Final Rejection for U.S. Appl. No. 17/297,436 dated Mar. 22, 2024, 9 pages.

International Search Report and Written Opinion for corresponding International Application No. PCT/EP2019/084781, dated Mar. 26, 2020, 12pp.

Office Action for U.S. Appl. No. 17/297,436 dated Nov. 14, 2023, 9 pages.

Russian Office Action (with English translation) for RU Application No. 2021111895/03(025527) dated Feb. 13, 2023, 15 pages.

Australian Examination Report for AU Application No. 2019400665 dated Oct. 25, 2024, 3 pages.

* cited by examiner (A)

(B)

(A)

(B)

(A)

(B)

(C)

(A)

(B)

(C)

ELONGATED SMOKING ARTICLE

CROSS-REFERENCE TO RELATED APPLICATION(S)

This application is a National Phase Patent Application of International Patent Application Number PCT/EP2019/084796, filed on Dec. 12, 2019, which claims priority of European Patent Application No. 18212908.0, filed Dec. 17, 2018. The entire contents of both of which are incorporated herein by reference.

FIELD OF THE INVENTION

The present invention relates to an elongated smoking article comprising a smoking body filled with a combustible material and a filer element attached to the smoking body via at least one tipping paper. According to the present invention, a flavoring is disposed in or on the tipping paper with a longitudinally anisotropic distribution. The present invention further relates to a tipping paper for an elongated smoking article according to the invention.

BACKGROUND

Elongated smoking articles, such as e.g. (filter) cigarettes or cigarillos, are usually of cylindrical shape and comprise a smoking body that is filled with a combustible material. Therein, the combustible material comprises tobacco or a tobacco related product, such as e.g. shredded tobacco or reconstituted tobacco. For forming the smoking body, the combustible material is surrounded by a wrapping paper. Usually cigarettes have a cylindrical filter element that is aligned with the smoking body. The filter element is configured to filter substances, e.g. tar, from the combustion gases emitted by the burning combustible material and might comprises cellulose acetate, paper, and/or charcoal. Usually, the filter element is packed using a so-called plug wrap, e.g., a paper plug wrap. The filter element is usually attached to one end of the tobacco rod using a circumscribing wrapping material known as tipping paper. Therein, the tipping paper is overlaid with and attached to both, the filter element and the smoking body as exemplarily shown in FIG. 1(*b*).

It is further known from the art to incorporate flavoring materials into smoking articles. Therein, the flavoring has been traditionally applied directly to the tobacco or to packaging material (from where they migrate to the tobacco) in order to flavor the tobacco smoke that reaches the mouth of the smoker. It is further known from the prior art that this effect may be achieved by applying the flavoring to the wrapping paper or the filter element of an elongated smoking article. For delivering an improved gustatory experience directly to the mouth of a user it is further known to apply a flavoring material to apart of the filter end of a smoking article contacting a user's lips. However, it is common to the known solutions that a smoker is inevitably confronted with the flavoring materials, irrespective of whether or not the user wants to experience the additional flavoring. Further, a smoker cannot adjust the amount of additional flavoring to be added to the smoking experience and thus either extensive product lines had to be developed or only rather weak flavoring was applied to the smoking articles in order to comfort the majority of consumers.

It is thus an object of the present invention to overcome or reduce the disadvantages of the prior art and to provide an elongated smoking article that allows a smoker to adjust the intensity of an additional flavoring supplied to the smoker during the smoking experience.

SUMMARY OF INVENTION

One or more of the drawbacks of the prior art could be avoided or at least reduced by means of the present invention, particularly by an elongated smoking article that is extending in a longitudinal direction. Preferably, the elongated smoking article is one of a filter cigarette or a filter cigarillo and/or is rod-shaped with a cylindrical body. The elongated smoking article comprises a cylindrical smoking body that is configured to be burned during smoking of the smoking article. Therefore, the smoking body comprises combustible material that is surrounded by a wrapping paper. Therein, the wrapping paper forms a cylindrical surface around the combustible material, wherein the base areas of the smoking body are preferably uncovered by the wrapping paper. The elongated smoking article further comprises a filter element that is configured to reduce specific substances from combustion gases that are emitted from the burning smoking body, particularly the burning combustible material. The filter element is attached to one of the base areas of the smoking body in an end-to-end relationship and elongates the smoking body. Particularly, a first base area of the filter element faces a base area of the smoking body in an end-to-end relationship. A second base area of the filter element is opposite the first base area and is an open base area of the filter element. In other words, the second base area is configured to be inserted into a smoker's mouth. Therefore, the filter element preferably is also of cylindrical shape with the same cross section as the smoking body. The filter element is further configured to draw combustion gases, i.e. smoke, from the burning smoking body. The filter element may comprise a filter plug, e.g., from cellulose acetate, that is wrapped in a so-called plug-wrap, which preferably is a paper plug wrap.

The elongated smoking article further comprises a tipping paper that is circumscribing the smoking body and the filter element. In other words, the tipping paper circumferentially encloses the cross sections of the smoking body and the filter element and extends in the longitudinal direction across the smoking body and the filter element. The tipping paper is further attached to the external surfaces of both, the smoking body and the filter element and thus connects the smoking body and the filter element. Preferably, the tipping paper is adhered to the external surfaces of the smoking body and the filter element.

According to the present invention, a flavoring is disposed in or on the tipping paper spaced apart from the second base area. In other words, a portion of the tipping paper directly adjacent to the second base area does not comprise any flavoring. Thus, a flavor-free spacer follows to the second base area in a longitudinal direction of the elongated smoking article.

Further, the flavoring is further disposed in or on the tipping paper with a distribution that varies in a longitudinal direction of the tipping paper. Therein, a flavoring is any substance that is capable of producing a gustatory sensation to a consumer, particularly when in contact with the lips of a consumer. Preferably, the flavoring is further capable of providing an olfactory sensation to the consumer (smoker, user), which might be independent of the contact with the consumer's lips. The longitudinally varying distribution refers to an amount of flavoring disposed in or on the filter element that varies, i.e. differs, along the longitudinal direction. The longitudinal varying distribution may also refer to different flavorings disposed in or on the filter element along the longitudinal direction.

The present invention thus provides an elongated smoking article with at least one flavoring disposed in or on the tipping paper of the filter element, wherein the amount of flavoring that is in contact with the lips of a smoker during smoking of the smoking article depends on a translational state of the elongated smoking article, particularly with respect to the longitudinal direction as referred to above. Therein, the translation occurs preferably with respect to the lips of a consumer. Additionally or alternatively, the type of flavoring in contact with the lips of a smoker during smoking depends on a translational state of the elongated smoking article, particularly with respect to the longitudinal direction. Thus, the elongated smoking article of the present invention allows a consumer to individually adjust the amount and/or type of the flavoring that is experienced during smoking. Hence, a producer can comfort a vast majority of consumer's personal taste with a single product.

Further, in the elongated smoking article of the present invention, preferably a flavoring-free spacer of the tipping paper is formed in the vicinity of a second base area of the filter element. A user usually sticks the filter element of the elongated smoking article in between his/her lips. In order to securely hold the elongated smoking article by the lips and for enabling the lips to close around the filter element, a user/smoker/consumer usually sticks the filter element into his/her mouth for a minimum distance, such that a portion of the filter element extending into the mouth of the user does not contact the user's lips. The elongated smoking article comprises a flavoring that is disposed in or on the tipping paper spaced apart from the second base area for a specific distance in the longitudinal direction. Preferably, the elongated smoking article comprises no flavoring disposed in or on the tipping paper within the specific distance from the second base area in the longitudinal direction. The specific distance preferably is at least 3 mm, preferably at least 5 mm, further preferred at least 8 mm, also preferred at least 10 mm and particularly preferred at least 15 mm. Hence, in the elongated smoking article the amount of flavoring can be advantageously reduced for that amount that is likely to not contact the user's lips anyway and thus to not contribute to the gustatory experience in a pleasant way. Further, by forming the flavoring-free spacer of the tipping paper in the vicinity of a second base area of the filter element that extends for the specific distance into the longitudinal direction, it can be prevented that a user's tongue contacts the flavoring directly. The tongue is much more sensible to the flavoring than the lips and thus contacting the flavoring with tongue directly may be unpleasant for the user.

In a particularly preferred embodiment, the elongated smoking article has a cylindrical shape, wherein the smoking body and the filter element are of cylindrical shape as well and wherein the tipping paper is disposed on the cylindrical surface of the filter element. Therein, the tipping paper may fully or partially cover the cylindrical surface of the filter element. Further, the tipping paper may partially cover the free base area of the filter element that is intended to be inserted into a smoker's mouth. Particularly preferred, the tipping paper is disposed on the whole cylindrical surface of the filter element.

According to this preferred embodiment, the flavoring is disposed within a first section of the tipping paper, wherein the first section is a cylindrical surface segment of the tipping paper, Particularly preferred, the filter element has a circular cross section and the tipping paper has a circular ring cross section. Then, the cylindrical surface segment is confined by a first circular (or elliptical) ring circumscribing the filter element and a second circular (or elliptical) ring circumscribing the filter element, wherein the second circular ring is spaced apart from the first circular ring along the longitudinal direction of the filter element and the elongated smoking article. Further, the first section is spaced apart from the second base area for at least 3 mm (the specific distance) in the longitudinal direction. In other words, each of the first circular (or elliptical) ring and the second circular (or elliptical) ring is spaced apart from the second base area. Preferably, the first circular (or elliptical) ring is disposed closer to the second base area of the filter element than the second circular (or elliptical) ring and a distance between the second base area and any point of the first circular (or elliptical) ring is at least 3 mm, preferably at least 5 mm, further preferred at least 8 mm, also preferred at least 10 mm and particularly preferred at least 15 mm. In this embodiment, the consumer can decide on whether or not the first section touches his upper and/or lower lip by translating the elongated smoking article along the longitudinal direction. Particularly by aligning the first section with the lips, the user can bring it into full contact with his or her upper and/or lower lip. By shifting the first section inside or outside of his or her mouth, the user can reduce the contact of the first section and his or her lips.

In a further preferred embodiment, the flavoring is further disposed within at least one second section of the tipping paper, wherein the second section is spaced apart from the first section in the longitudinal direction. Therein, the first section may be disposed between the second section and the second base area or the second section may be disposed between the first section and the second base area. Preferably, the filter element has the circular cross section, the tipping paper has the circular ring cross section and the second section is confined by a third and fourth circular (or elliptical) ring circumscribing the filter element, respectively. Therein, the third and fourth circular rings are spaced apart from each other and from the first and second circular ring along the longitudinal direction. Further preferred, a first flavoring is disposed in the first section and a second flavoring is disposed in a second section. Hence, a user can vary the type of experienced flavoring by shifting the elongated smoking article along the longitudinal direction. However, also the same flavoring may be disposed in the first and second section, wherein the concentration of the flavoring may vary between the first and second section and/or the width of at least one second section in the longitudinal direction differs from the width of the first section in the longitudinal direction. Hence, a user can vary the intensity of the experienced flavoring by shifting the elongated smoking article.

According to a particularly preferred embodiment, the flavoring is disposed within a plurality of cylindrical surface segments of the tipping paper, as described above. Therein, each of the cylindrical surface segments is enclosed by two circular or elliptical rings circumscribing the filter element as described above with respect to the first and second section. In the following, the cylindrical surface segments are referred to as cylindrical sections. According to these embodiments, the cylindrical sections are spaced apart from each other in the longitudinal direction. Hence, by disposing different types or concentrations of flavoring in the individual cylindrical sections, a user can vary the type and/or the intensity of experienced flavoring by shifting the elongated smoking article along the longitudinal direction.

Further preferred, the width of the cylindrical sections varies along the longitudinal direction. Exemplarily, the width of the cylindrical sections may increase or decrease with increasing distance to the mouthpiece end of the filter element. Thus, even by applying a flavoring of identical concentration to each of the cylindrical sections, the user can vary the intensity of experienced flavoring by shifting the elongated smoking article along the longitudinal direction. Additionally or alternatively to varying the width of the cylindrical sections, the spacing between the cylindrical sections varies along the longitudinal direction. Exemplarily, the distance between cylindrical sections may increase or decrease with increasing distance to the mouthpiece end of the filter element. Again, even with flavoring of identical concentration in each cylindrical section, the user can vary the intensity of experienced flavoring by shifting the elongated smoking article along the longitudinal direction. In other words, by setting the width of the sections and/or the distance between sections along the longitudinal direction, the density (concentration) of flavoring per surface unit of the whole filter element and thus the intensity of the corresponding user experience can be varied.

Also preferred, the concentration of flavoring differs in different cylindrical sections. Therein, a flavoring of identical or similar type can be disposed in or on different cylindrical sections with different concentrations. Exemplarily, the concentration of a flavoring in a cylindrical section may increase or decrease with increasing distance of the cylindrical section to the mouthpiece end of the filter element. Hence, even by using cylindrical sections of the same size and/or with the same spacing, the user can vary the intensity of experienced flavoring by shifting the elongated smoking article along the longitudinal direction. Additionally or alternatively, different flavorings may be disposed within different cylindrical sections. Therein, the types of flavoring may differ between each of the cylindrical sections or between groups of cylindrical sections. Thus, the user can vary the type of experienced flavoring by shifting the elongated smoking article along the longitudinal direction.

In a particularly preferred embodiment, the remaining tipping paper, i.e. the tipping paper outside the sections or segments as described above, does not comprise any flavoring. Thus, the user may further adjust the smoking experience by translating the smoking article such that none of the sections is in contact with the consumer's lips and thus no gustatory sensation is experienced in addition to that provided by the combustion gases of the smoking body. In other words, the above descriptions referring to sections of the tipping paper in or on which flavoring is disposed refer to an exclusive application of flavoring to these sections. By applying such exclusively filled sections, the above described advantages are provided.

In an alternatively preferred embodiment, the concentration of flavoring changes continuously and/or gradually along the longitudinal direction of the tipping paper. Also which such an embodiment, a flavoring can be disposed in or on the tipping paper with a distribution that varies in a longitudinal direction of the tipping paper, wherein the longitudinally varying distribution refers to an amount and/or type of flavoring disposed in or on the filter element that varies, i.e. differs, along the longitudinal direction. In other words, the concentration of at least one or a plurality flavoring changes continuously and or gradually along the longitudinal direction of the tipping paper. In this embodiment, different sections or segments of the tipping paper as described above may also be provided, wherein however the boundaries of these sections must then not be completely fixed. Exemplarily, the embodiments with a plurality of cylindrical surface segments (cylindrical sections) of the tipping paper being spaced apart from each other in the longitudinal direction and comprising one or more flavorings may also be provided with concentrations of the flavoring that change continuously along the longitudinal direction. The concentration of flavoring may increase with increasing distance from the second base area. However, the concentration of flavoring may also decrease with increasing distance from the second base area. Further, the continuously and/or gradually changing distribution of the flavoring is spaced apart from the second base area for the specific distance in the longitudinal direction of the elongated smoking article.

Further preferred, the sections of the tipping paper comprising the flavoring as described above might extends across the whole circumference of the tipping paper in the circumferential direction. In other words, an amount and/or type of flavoring that is contacting a smoker's lips does not depend on a rotational state of the elongated smoking article with respect to the circumferential direction thereof. Hence, the concentration and/or type of flavoring experienced by a consumer do not depend on such rotational state.

However, according to an alternatively preferred embodiment, the distribution of the flavoring does further vary in a circumferential direction of the tipping paper. In other words, the amount and/or type of flavoring that is contacting a smoker's lips does further depend on a rotational state of the elongated smoking article with respect to the circumferential direction.

Thus the concentration and/or type of flavoring experienced by a consumer do depend on such rotational state. In a most simple embodiment, the sections as described above may not extend across the whole circumference of the filter element but multiple sections with a flavoring disposed thereon or therein may be provided along the circumference of the filter.

According to this preferred embodiment, the circumferentially varying distribution refers to an amount of flavoring disposed in or on the filter element that varies, i.e. differs, along the circumferential direction. The circumferentially varying distribution may also refer to different flavorings disposed in or on the filter element along the circumferential direction. Particularly preferred, the filter element has a circular cross section, the tipping paper has a circular ring cross section and the flavoring is disposed within a first angular section of the tipping paper, wherein the first angular section is disposed on a first circle sector of the filter element, particularly on a first circle sector of the cross section of the filter element. As the tipping paper extends along the filter element in a longitudinal direction, the first angular section is actually disposed on a plurality of first circle sectors of multiple cross sections of the filter element. Therein, these first circle sectors are aligned in the longitudinal direction. Herein a circle sector refers to a portion of a disk that is enclosed by two radii and an arc, where the two radii enclose the central angle. Preferably, the central angle of the first circle sector is less than 180° and particularly preferred less than 90°. In other words, in a cross section, the first angular section is a first circumferential section of the tipping paper, i.e. a section of the circular ring cross section of the tipping paper.

Further preferred, flavoring is further disposed within a second angular section of the tipping paper. The second angular section is disposed on a second circle sector of the filter element, particularly on a second circle sector of the cross section of the filter element. Also the second angular section is disposed on a plurality of second circle sectors of multiple cross sections of the filter element, with these circle sectors being aligned in the longitudinal direction. Preferably, the central angle of the second circle sector is less than 180° and particularly preferred less than 90°. In other words, in a cross section the second angular section is a second circumferential section of the tipping paper, i.e. a section of the circular ring cross section of the tipping paper. Preferably, the second angular section is opposite to the first angular section. Particularly preferred, the second angular section is a point reflection of the first angular section with respect to a rotational symmetry axis of the filter element, particularly in a cross section of the elongated smoking article. Alternatively, the second angular section is rotated from the first angular section about an angle of less than 180 degrees.

Thus, according to this preferred embodiment, the consumer can decide on whether or not the first angular section and/or the second angular section touches his upper or lower lip by rotation the elongated smoking article. Particularly by aligning the first angular section with a vertical direction, he or she can bring it into full contact with his or her upper or lower lip, while by aligning the first angular section with a horizontal direction the user can reduce the contact of the first angular section and his or her upper or lower lip. Therein, the degree of contact naturally depends on the central angle of the first circle sector. Depending on the relative position of the second angular section, the second angular section may be in contact with the consumer's lips together or alternating with the first angular section.

The preferred embodiment of the invention thus provides an elongated smoking article with at least one flavoring disposed in or on the tipping paper of the filter element, wherein the amount of flavoring that is in contact with the lips of a smoker during smoking of the smoking article depends on the rotational state and the translational state of the elongated smoking article. Therein, the rotational state is preferably defined with respect to the circumferential direction as referred to above and the translational state is preferably defined with respect to the longitudinal direction as referred to above. Therein, the rotation occurs preferably around a rotational symmetry axis of the filter element and/or the translation occurs along a length axis of the filter element. Additionally or alternatively, the type of flavoring in contact with the lips of a smoker during smoking depends on the rotational state and the longitudinal state of the elongated smoking article. Thus, the elongated smoking article of the present invention allows a consumer to individually adjust the amount and/or type of the flavoring that is experienced during smoking by moving the smoking article in two dimensions. Hence, a producer can comfort an even larger majority of consumer's personal taste with one product.

In a preferred embodiment, the flavoring that is disposed in and/or on the tipping paper is applied in form of a solution of the flavoring to the tipping paper. More general, the flavoring is applied as an at least initially not solid substance to the tipping paper. Preferably, the flavoring is printed to the tipping paper. Thus, the flavoring may include or be included in a variety of substrates for application to the tipping material such as, for example, inks, films, or other compositions that may include one or more pigments, fillers, and/or optical brightening agents. In a preferred embodiment, the flavoring composition is formulated to be printed on one or both sides of tipping material before, during, or after assembly of a smoking article such as a cigarette. However, the formulation may also be applied by other means including, for example, misting, spraying, or soaking the tipping material. One or more flavoring compositions may be incorporated into tipping material during its manufacture.

At least one layer of flavoring and possibly several layers of one or more flavorings is applied to a wrapping paper, preferably using a printing process. Most preferably, the flavoring is applied using gravure coating techniques, such as e.g. rotogravure printing techniques. Other preferred techniques for the applying the flavoring to the wrapping material include blade coating, air-knife coating, roll-coating and shaft coating techniques. Alternatively and/or additionally, the flavoring can be applied by spraying, ink jet coating, or other similar printing techniques. A printed wrapping paper can thus be provided with a distribution of at least one flavoring according to the invention. Gravure printing techniques involve printing from the continuous surface of a metal cylinder engraved mechanically or etched chemically so as to possess minute grooves or cells below the surface of that cylinder. A typical printing cylinder surface is provided by etching a smooth, polished copper surface and plating that etched surface with chrome. Those recessed cells or grooves hold liquid (or liquid dispersion) formulations form impressions, layers or "bumps" to be deposited onto the desired location of a substrate, such as a continuous web of paper wrapping material. Other printing techniques may be used as well, including flexographic, ink-jet, thermal-transfer (including laser), screen printing, or any other method for transferring a flavoring composition to a paper or paper-like material such as tipping paper.

Different solvents may be selected to carry the flavoring during application. Most solvents preferably will evaporate and/or will not have a negative impact upon the flavoring (including a smoker's experience thereof). Preferably, the solvent will not disrupt or damage the structure of the plug wrap, the wrapping paper or the tipping paper (e.g., by weakening it) or negatively affecting its appearance, nor will it confer any undesirable flavor.

Additionally or alternatively to the printing-type and other applications described herein, at least one flavoring might be applied with an adhesive to the tipping material. Some examples of flavorings that may be printed or otherwise applied to the tipping material or in the adhesive include methyl cyclopentenolone, vanillin, ethyl vanillin, inulin, and aromatic oil. Other flavorings (including flavor and aroma precursors) include, for example, vanillin glucoside and/or ethyl vanillin glucoside. Other flavorings may include, for example, ethyl vanillin, caryophyllene oxide, sugars (e.g., rhamnose), and different flavor precursors that will produce a flavor and/or aroma when contacted by the lips or tongue of a smoker and/or heat and/or moisture from mainstream aerosol. Inks that are useful as flavorings provide a scent, aroma, or other olfactory sensation.

The flavorings may be incorporated by means other than printing to one or both surfaces of the tipping paper. For example, the tipping paper may be dipped into a flavoring material such that it will be absorbed thereby and/or will adsorb to surfaces of material making up the tipping paper. As another example, microcapsules configured to release flavoring(s) may be incorporated into the tipping paper, for example, upon contact with moisture and/or warmth of a smoker's lips. Examples of such capsules may comprise synthetic capsules and/or biologically-derived "capsules", such as e.g., yeast organisms as a delivery means.

Flavoring includes any material that may be applied to the tipping paper and that provides one or more of a selected organoleptic sensation, a sensation of one or more tastes/flavors and/or scents/aromas that may be transmitted orally and/or olfactory, trigeminal nerve stimulation sensation, and may include a cool, warm, spicy, tangy, salty, tingly, bitter, sour, hot, sweet, or tart sensation for a smoker, or any combination of any of these sensations. Flavorings may be encapsulated or added directly. They may be printed together with, under, or on top of the inks that are commonly applied to tipping materials to provide a particular appearance (e.g., appearance of cork, lettering and/or logos, visible patterns, etc.). Flavorings may also be applied with lip-release (in the cigarette art, the term "lip-release" refers to materials configured to promote easy release of contact between human lips and the tipping-material-covered filter section of a cigarette without substantial sticking, and the lip-release material referred to herein may include any standard lip-release formulations currently known and/or practiced in the art, or developed in the future). A flavoring will provide a smoker with at least one oral and/or olfactory sense beyond a tactile contact with and other normal sensation associated with a tipping material lacking a flavoring.

In the context of this application, the flavoring may impart flavor directly to a smoker's lips and/or tongue via contact with the tipping paper. Alternatively or additionally, flavor may be provided from the flavoring by releasing an odor—whether passively, upon contact with a smoker, or upon being heated by passage of, for example, combustion gases of the burning smoking body. Release of flavor-affecting material (whether by or to the mouth and/or nose of the smoker) can be activated or intensified by heating the flavoring when a smoker draws the combustion gases through the filter such that these gases are proximate the flavoring. Moisture may also serve as a releasing means for flavor (e.g., from contact with a smoker's lips and/or tongue).

Some preferred flavorings will exhibit sensory characteristics that can be described as having notes that are sweet, woody, fruity, or some combination thereof. The flavorings are preferably employed in amounts that depend upon their individual detection thresholds.

Combinations of flavorings may be used to provide one or more desired sensory characteristics to the experience of a smoker from the smoking articles incorporating those flavorings. Above that, some flavorings will provide a unique sensation to a smoker that may include, but go beyond one or more of taste, smell, and tactile sensation. For example, such flavorings may include menthol, menthanes, menthones, sweet proteins (e.g., thaumatin, monellin), essential oils containing menthol or menthol-like compounds (e.g., peppermint), other essential oils (wintergreen, spearmint), succinate esters, capsaicin, cinnamon, or any commercially-available (or future-developed) "cooling compounds" or "spicy compounds".

Preferred flavorings may be incorporated into printing formulations, will have low vapor pressures, will not have a tendency to migrate or evaporate under normal ambient conditions, and will be stable under the processing conditions experienced by tipping papers according to the present invention. Exemplary flavorings that provide sweet notes include ethyl vanillin, vanillin, and inulin (a fructose oligomer).

According to an alternatively preferred embodiment, the flavoring is disposed on the tipping paper by applying at least one layer of flavoring material on the tipping paper. In other words, in this embodiment the filter element and the smoking body are circumscribed by a first tipping paper that is attached to the external surfaces of the smoking body and the filter element and then at least one additional layer of flavoring material, e.g. a band or stripe of a second tipping paper, is attached to the external surface of the first tipping paper. Therein, the flavoring material may comprise the flavoring with a constant concentration and the varying concentration along the longitudinal direction of the filter element is achieved by applying a varying amount of the flavoring material along the longitudinal direction. Alternatively, the flavoring material may comprise the flavoring with varying directions, wherein a gradient of these varying concentrations is aligned with the longitudinal direction of the filter element. This embodiment advantageously allows applying the present invention belatedly to standard elongated smoking articles. Further, in this embodiment, a consumer can advantageously feel the flavoring material as elevation with his lips. Additionally or alternatively, and isolated (detached) from this specific embodiment, the sections comprising the flavoring, or more generally the concentration of flavoring, may be indicated by coloring the tipping paper in order to provide guidance to a consumer.

Another aspect of the present invention is directed to a tipping paper for an elongated smoking article according to the invention as described above. Therein, the tipping paper is configured to circumscribe a smoking body and a filter element as described above and is configured to be attached to the external surfaces of a smoking body and a filter element as described above. Further, a flavoring is disposed in or on the tipping paper according to the invention with a distribution that varies in a direction of the tipping paper that is to become the longitudinal direction of the tipping paper once it is circumscribing the filter element, particularly a cylindrical filter element of an elongated smoking article extending in the longitudinal direction. Further preferred, the distribution of the flavoring also varies in a direction of the tipping paper that is to become the circumferential direction of the tipping paper once it is attached to the filter element. The preferred embodiments described above with respect to the elongated smoking article do apply to the tipping paper of the invention.

BRIEF DESCRIPTION OF DRAWINGS

Further features of the invention will become apparent to those of ordinary skill in the art by describing in detail exemplary embodiments with reference to the attached drawings in which.

DETAILED DESCRIPTION OF AN EXAMPLE EMBODIMENT

Figure 1:
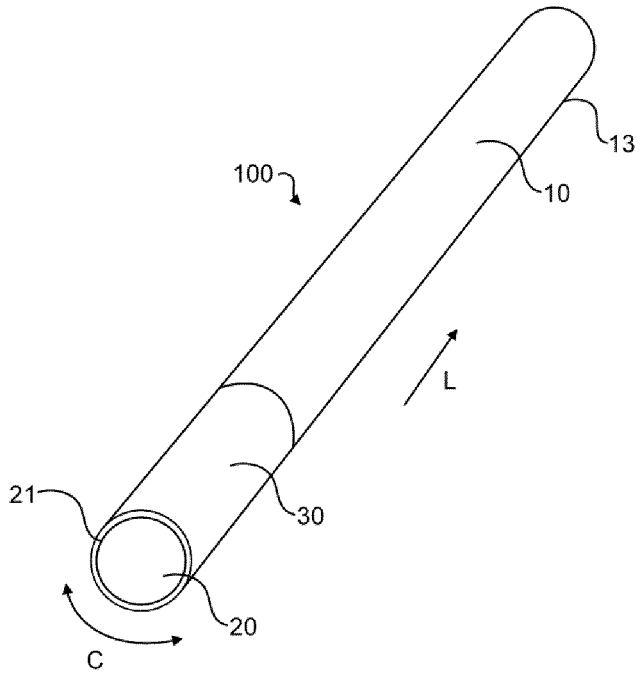
FIG. 1 (A) illustrates a schematic perspective view of an elongated smoking article and (B) illustrates a schematic cross section side view of an elongated smoking article.
Figure 1:
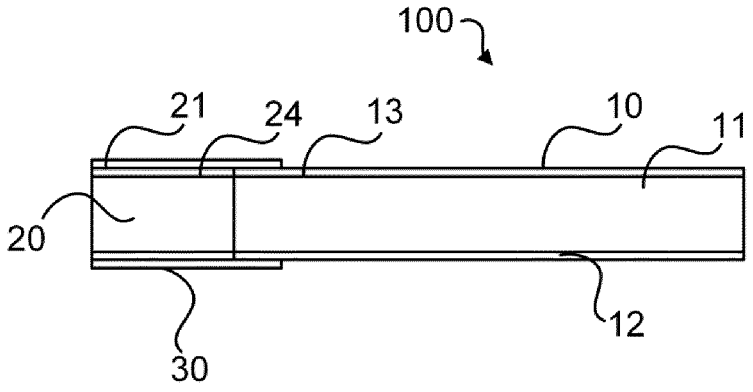

With reference to FIG. 1, a filter cigarette is shown as an example of an elongated smoking article 100 in (A) a schematic perspective view of an elongated smoking article and (B) a schematic cross section side view. The filter cigarette 100 includes a cylindrical rod of combustible material 11 the cylindrical surface of which is surrounded by a wrapping paper 12. The wrapping paper 12 typically incorporates a fibrous material, such as a cellulosic material, e.g. a lignocellulosic material. Exemplary cellulosic materials include flax fibers, hardwood pulp, softwood pulp, hemp fibers, esparto fibers, kenaf fibers, jute fibers and sisal fibers. Mixtures of two or more types of cellulosic materials can be employed.

The combustible material 11 within the wrapping paper 12 is referred to as smoking body 10 and one base area of the smoking body 10 is open to expose the combustible material 11. At one base area of the smoking body 10 the combustible material 11 can be lightened and at the other base area a filter element 20 is positioned. The filter element 20 may be at least partially formed of a weave, mesh, paper, membrane, and/or other appropriate structure providing the desired diffusivity. Its thickness and density may be determined during manufacture or altered thereafter to provide desired diffusivity.

The filter element 20 and the smoking body 13 are axially aligned in an end-to-end relationship along a longitudinal relationship L of the filter cigarette. The filter element 20 has a generally cylindrical shape with a diameter that is essentially equal to the diameter of the smoking body 10. The base areas 25, 26 of the filter element 20 are open to permit the passage of air and smoke therethrough. One of these base areas, i.e., the first base area 25, contacts the smoking body 10 and the other base area opposite the first base area, i.e., the second base area 26, forms a mouthpiece for a user. The filter element 20 includes a filter material, such as e.g. plasticized cellulose acetate or a biodegradable material, which is configured to reduce substances in combustion gases that are drawn by a smoker from the burning smoking body 10 through the mouthpiece base area of the filter element 20. Further, the filter material is circumferentially wrapped in a paper plug wrap 24.

The filter element 20 is fixed to the smoking body 10 via a tipping paper 30 that is circumscribing both, the filter element 20 and the smoking body 10. The tipping paper 30 is wrapped over the filter element 20 and the smoking body 10 along the longitudinal direction L and is attached by an adhesive to an external surface 13 of the smoking body 10 and to an external surface 21 of the filter element 20. Thus, the tipping paper 30 provides a force closure between smoking body 10 and filter element 20 via an indirect adhesive bond using a suitable adhesive, such as e.g., a water-based adhesive of the type traditionally employed by cigarette manufacturers for application of tipping paper during filtered cigarette manufacture. In other words, the tipping paper 30 extends around the longitudinally extending periphery of substantially the entire length of the filter element 20 and around a portion of the longitudinally extending periphery of the wrapping paper 12 of the combustible material 11 in a region of the smoking body 10 immediately adjacent to the filter element 20.

Figure 2:
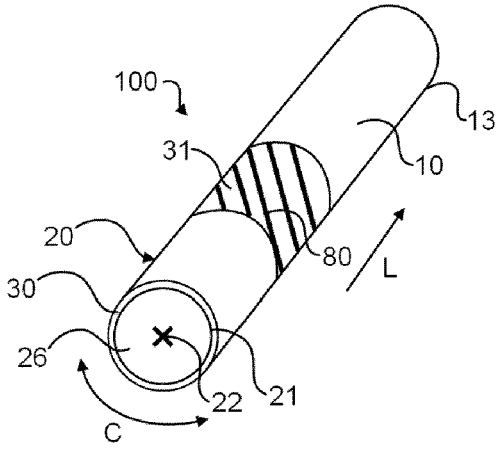
FIG. 2 illustrates a filter element of an elongated smoking article according to a first embodiment.

FIG. 2 illustrates a schematic perspective view of a filter element 20 of an elongated smoking article 10 according to a first embodiment of the invention. Therein the filter element 20 has a circular cross section 23 and the tipping paper 30 has a circular ring cross section 33 and is disposed on the cylindrical surface of the filter element 20. A flavoring 80 is disposed in and/or on a first section 31 of the tipping paper 30. Further, no flavoring 80 is disposed in or on the remaining tipping paper 30 outside the first section 31, particularly no flavoring 80 is disposed within a specific distance from the second base area 26 (open base area) into the longitudinal direction towards the smoking body 10. The first section 31 is a first cylindrical segment of the tipping paper 30 that is enclosed by a first and a second circular ring circumscribing the filter element 20. The first section 31 is positioned at a distal end of the filter element 20 near the first base area 25 of the filter element 20 opposite to a mouthpiece of the filter element 20 near the second base area of the filter element 20.

Figure 3:
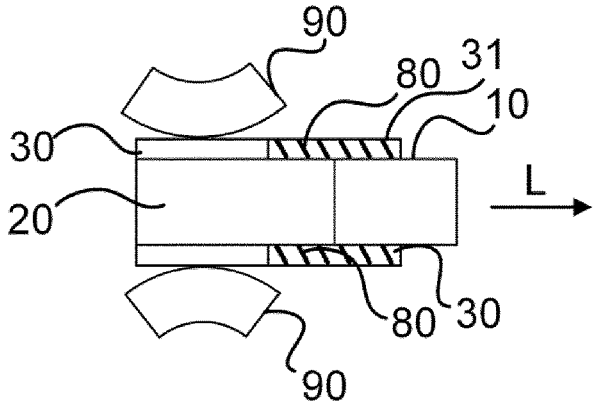
FIG. 3 illustrates the interaction of the filter element of the first embodiment with the lips of a smoker in (A) a first configuration and (B) a second configuration.
Figure 3:
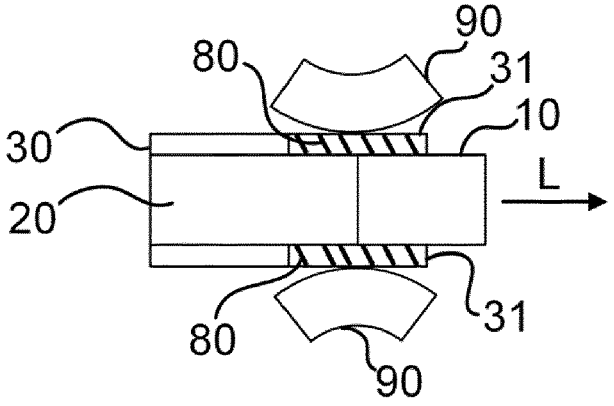

In FIG. 3 the interaction of the filter element 20 of the filter cigarette 100 according to the first embodiment as shown in FIG. 2 with the lips of a smoker 90 is shown in (A) a first configuration and (B) a second configuration. In the first configuration (A), the first section 31 containing the flavoring 80 is shifted outside the mouth of a consumer and thus the lips 90 of the consumer does thus not contact the first section 31 with the flavoring 80 but only contact the filter element 20 along the specific distance from the second base area 26 in the longitudinal direction along which no flavoring is present in or on the tipping paper 30. Hence, the consumer experiences no gustatory or olfactory sensation based on the flavoring 80. However, by shifting (translating) the elongated smoking article 100 into the mouth of the consumer, the first section 31 is brought in contact with the lips 90 of the consumer as illustrated in the configuration of FIG. 3 (B). Hence, the flavoring 80 disposed in the first section 31 is brought into contact with the lips 90 of the consumer and the consumer thus experiences a gustatory sensation based on the flavoring. By shifting the filter cigarette 100 along the longitudinal direction into or out of the mouth, the consumer can thus decide on whether or not he or she wants to experience the sensation of the flavoring 80.

Figure 4:
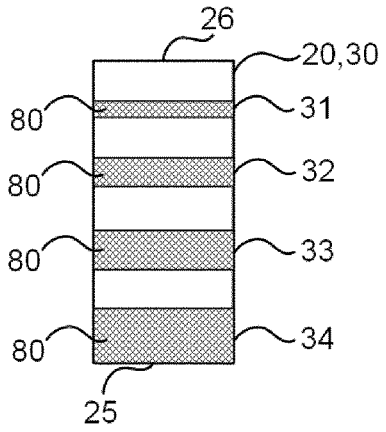
FIG. 4 schematically illustrates the circumference of filter elements of an elongated smoking articles according to (A) a second embodiment, (B) a third embodiment and (C) a fourth embodiment.
Figure 4:
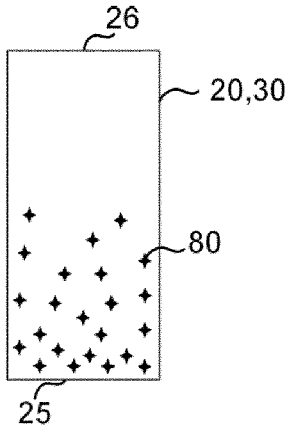
Figure 4:
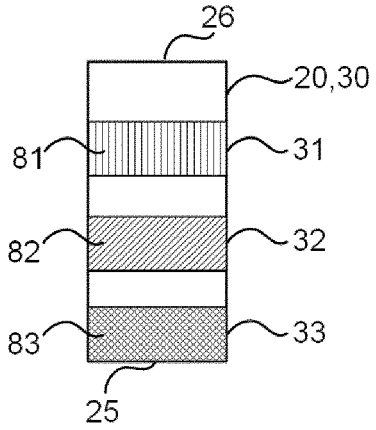

Further embodiments of the tipping papers 30 of elongated smoking articles 100 according to embodiments of the invention are illustrated in FIG. 4 illustrating front views of cylindrical filter elements 20. Therein, the longitudinal direction L of the filter elements 20 equals the downward vertical direction in FIG. 4 and the upper ends of the filter elements 20 are the mouthpiece ends of the filter elements 20, i.e., the second base areas 26 of the filter elements 20, and the lower ends of the filter elements 20, i.e., the first base areas 25 of the filter elements 20, are the ones contacting the smoking bodies 10.

In a second embodiment as illustrated in FIG. 4 (A), a flavoring 80 is disposed in a total of four cylindrical sections 31, 32, 33, 34 that are spaced apart from each other along the longitudinal direction L of the filter element 20. Therein, the width of the cylindrical sections 31, 32, 33, 34 decreases along the longitudinal direction. Hence, the user can adjust the intensity of the flavoring 80 by shifting the filter element 20 further inside or outside his mouth, wherein the gustatory experience of the flavoring 80 is more intensive, the closer the lips of the consumer touch the filter element 20 to the mouthpiece end thereof.

In a third embodiment as illustrated in FIG. 4 (B), a flavoring 80 is disposed on the tipping paper 30 circumscribing the filter element 20 with a continuous concentration gradient. Therein, a concentration of the flavoring 80 is highest at the first base area 25, i.e., opposite the mouthpiece end (second base area 26) of the filter element 20 and fades continuously towards the mouthpiece end, i.e., the second base area 26 of the filter element 20. Hence, FIG. 4 (B) provides the same effect as the embodiment of FIG. 4 (A) but with a continuous gradient of flavoring 80 instead of a four-fold discrete gradient of flavoring 80 based on a changing width of sections 31 to 34. Hence, a user can even more freely set the amount of experienced flavoring by shifting the filter element 20. However, the continuous concentration gradient could also have a reversed direction, i.e., increasing from the first base area 25 towards the second base area 26.

In a fourth embodiment as illustrated in FIG. 4 (C), a first flavoring 81 is disposed in first cylindrical section 31 close to the second base area 26 of the filter element 20 and a third flavoring 83 is disposed in third cylindrical section 33 close to the first base area 25 of the filter element 20. Further, a second flavoring 82 is disposed in second cylindrical section 32 in between the first 31 and the third cylindrical section 33. Hence, the user can adjust the type of the flavoring 81, 82, 83 by shifting the filter element 20 further inside or outside his mouth.

Figure 5:
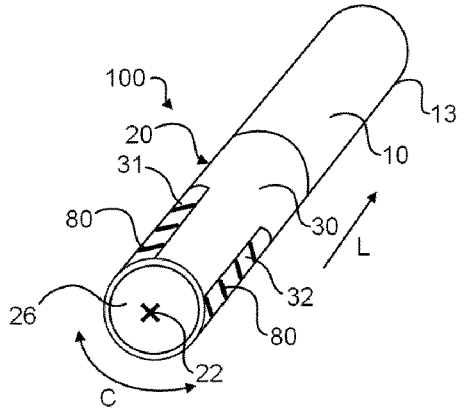
FIG. 5 illustrates filter elements of elongated smoking articles according to (A) a fifth embodiment, (B) a sixth embodiment, and (C) a seventh embodiment.
Figure 5:
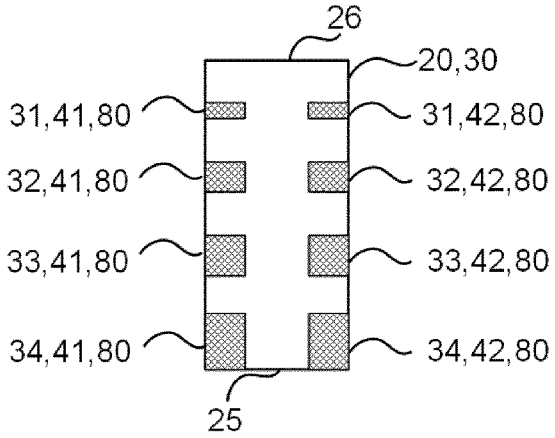
Figure 5:
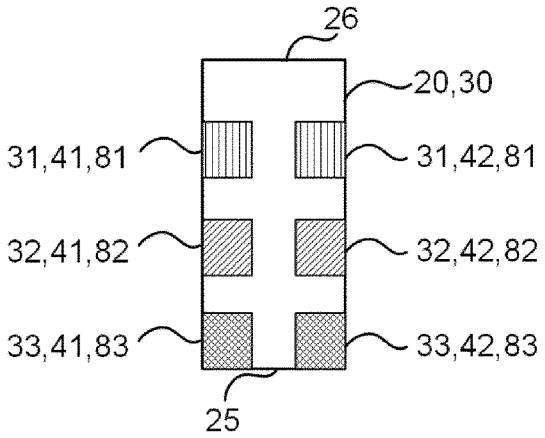

FIG. 5 illustrates filter elements 20 with a circumscribing tipping paper 30 according to the invention according to a fifth embodiment (A), a sixth embodiment (B), and a seventh embodiment (C). These embodiments have in common that a distribution of a flavoring 80 further varies in a circumferential direction C of the tipping paper 30. Therein the amount and/or the type of flavoring 80 that is contacting a smoker's lips 90 further depends on rotational state of the elongated smoking article 100 with respect to the rotation axis 22.

In the filter element 20 of the fifth embodiment of FIG. 5 (A), the cylindrical section comprising the flavoring 80 does not extend along the whole circumference of the filter element 20. On the contrary, the cylindrical section is divided in a first angular section 31 and a second angular section 32. Each of the first and second angular sections 31, 32 extends only partially in the circumferential direction and the longitudinal direction of the filter element 20. Thus, a user can decide whether or not he or she wants to experience the sensation of the flavoring 80 by rotating the filter element 20, if the half of the filter element 20 proximal to its mouthpiece end is in contact with the lips 90 of the user. However, by further inserting the filter element 20 into the mouth of the user, such that a half of the filter element 20 distal to its mouthpiece end is in contact with the lips 90 of the user, the user can decide to not experience the flavoring 80 irrespective of the rotational state of the filter element 20.

In the filter element 20 of the sixth embodiment of FIG. 5 (B), a flavoring 80 is disposed in a first angular section 41 and a second angular section 42. Further, the flavoring 80 is disposed in four cylindrical sections 31, 32, 33, 34 of the tipping paper 30 as described above. By combining the circumferentially varying distribution of flavoring 80 based on the first and second angular sections 41, 42 with the longitudinally varying distribution of flavoring 80 based on the first to fourth cylindrical sections 31, 32, 33, 34 a total of eight sections is generated that provides a distribution of flavoring 80 that varies in the longitudinal and the circumferential direction. Thus, a user can adjust whether or not he wants to experience the flavoring 80 by rotating the filter element 20 around a rotational symmetry axis 22 of the filter element 20 and can further adjust the intensity of the experienced flavoring 80 by translating the filter element 20 along the longitudinal direction of the filter 20.

In the filter element 20 of the seventh embodiment of FIG. 5 (C), a first flavoring 81 is disposed in a first angular section 41 of the tipping paper 30 and in a second angular section 42 of the tipping paper 30. Further, the first flavoring 81 is disposed in a third cylindrical section 33 of the tipping paper 30. A second flavoring 82 is disposed in the first angular section 41 and the second angular section 42 as well as in a second cylindrical section 32 of the tipping paper 30. Finally, a third flavoring 83 is disposed in the first angular section 41 and the second angular section 42 as well as in a third cylindrical section 33 of the tipping paper 30. By combining the circumferentially varying distribution of flavorings 81, 82, 83 based on the first and second angular sections 41, 42 with the longitudinally varying types of flavorings 81, 82, 83 based on the first to third cylindrical sections 31, 32, 33 a total of six sections is generated that provides a distribution of flavorings 81, 82, 83 that varies in the longitudinal and in the circumferential direction. Thus, a user can adjust whether or not he wants to experience any flavoring 81, 82, 83 by rotating the filter element 20 around a rotational symmetry axis of the filter element 20 and can further adjust the type of the experienced flavoring 81, 82, 83 by translating the filter element 20 along the longitudinal direction L of the filter element 20.

REFERENCE SIGNS

10 cylindrical smoking body
11 combustible material
12 wrapping paper
13 external surface of the smoking body
20 filter element
21 cylindrical surface of the filter element
22 rotational symmetry axis of the filter element
23 cross section of the filter element
24 plug wrap
25 first base area
26 second base area
30 tipping paper
31 first cylindrical section of the tipping paper
32 second cylindrical section of the tipping paper
33 third cylindrical section of the tipping paper
34 fourth cylindrical section of the tipping paper
41 first angular section
42 second angular section
80 flavoring
81 first flavoring
82 second flavoring
83 third flavoring
90 smoker's lips
100 elongated smoking article
L longitudinal direction
C circumferential direction

The invention claimed is:

1. Elongated smoking article, comprising:

a cylindrical smoking body extending in a longitudinal direction with a combustible material surrounded by a wrapping paper;

a filter element configured to reduce substances from combustion gases drawn through the filter element from the burning smoking body, wherein a first base area of the filter element faces a base area of the smoking body and a second base area is an open base area; and a tipping paper enclosing the smoking body and the filter element and being attached to external surfaces of the smoking body and the filter element, wherein a flavoring is disposed in or on the tipping paper such that the flavoring is spaced apart from the second base area in the longitudinal direction and with a distribution that varies in a longitudinal direction of the tipping paper, wherein a content of the flavoring either continuously increases or continuously decreases in the longitudinal direction of the tipping paper.

2. Elongated smoking article according to claim 1, wherein the amount and/or type of flavoring contacting a smoker's lips depends on a translational state of the elongated smoking article with respect to the longitudinal direction.

3. Elongated smoking article according to claim 1, wherein the filter element has a cylindrical shape and the tipping paper is disposed on the cylindrical surface of the filter element.

4. Elongated smoking article according to claim 3, wherein the flavoring is disposed within a first section of the tipping paper, the first section being a cylindrical surface segment of the tipping paper, the first section being spaced apart from the second base area for at least 3 mm in the longitudinal direction.

5. Elongated smoking article according to claim 3, wherein the flavoring is disposed within a plurality of cylindrical surface segments of the tipping paper, the cylindrical surface segments being spaced apart from each other in the longitudinal direction.

6. Elongated smoking article according to claim 5, wherein the width of the cylindrical surface segments varies along the longitudinal direction.

7. Elongated smoking article according to claim 5, wherein the spacing between the cylindrical surface segments varies along the longitudinal direction.

8. Elongated smoking article according to claim 5, wherein the concentration of flavoring differs in different cylindrical surface segments.

9. Elongated smoking article according to claim 5, wherein different flavorings are disposed within different cylindrical surface segments.

10. Elongated smoking article according to claim 4, wherein the remaining tipping paper does not comprise any flavoring.

11. Elongated smoking article according to claim 10, wherein a concentration of flavoring changes continuously along the longitudinal direction of the tipping paper.

12. Elongated smoking article according to claim 11, wherein the distribution of the flavoring further varies in a circumferential direction of the tipping paper and wherein the amount and/or type of flavoring contacting a smoker's lips further depends on rotational state of the elongated smoking article with respect to the circumferential direction.

13. Elongated smoking article according to claim 12, wherein the flavoring is disposed in and/or on the tipping paper by applying a solution of flavoring to the tipping paper.

14. Elongates smoking article according to claim 13, wherein the flavoring is disposed on the tipping paper by applying at least one layer of flavoring material on the tipping paper.

15. Tipping paper for an elongated smoking article comprising: the tipping paper according to claim 1.

16. Elongated smoking article according to claim 1, wherein a concentration of flavoring changes continuously along the longitudinal direction of the tipping paper.

17. Elongated smoking article according to claim 1, wherein the distribution of the flavoring further varies in a circumferential direction of the tipping paper and wherein the amount and/or type of flavoring contacting a smoker's lips further depends on rotational state of the elongated smoking article with respect to the circumferential direction.

18. Elongated smoking article according to claim 1, wherein the flavoring is disposed in and/or on the tipping paper by applying a solution of flavoring to the tipping paper.

19. Elongated smoking article according to claim 1, wherein the flavoring is disposed on the tipping paper by applying at least one layer of flavoring material on the tipping paper.

* * * * *